US012397191B2

(12) United States Patent
Aoki et al.

(10) Patent No.: US 12,397,191 B2
(45) Date of Patent: Aug. 26, 2025

(54) LOWER LIMB EXERCISE DEVICE AND EXERCISE SYSTEM

(71) Applicant: TOYOTA JIDOSHA KABUSHIKI KAISHA, Toyota (JP)

(72) Inventors: Eisuke Aoki, Toyota (JP); Tomio Ikeda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 106 days.

(21) Appl. No.: 18/381,200

(22) Filed: Oct. 18, 2023

(65) Prior Publication Data

US 2024/0149108 A1 May 9, 2024

(30) Foreign Application Priority Data

Nov. 8, 2022 (JP) ..... 2022-178771

(51) Int. Cl.
*A63B 22/06* (2006.01)
*A47C 9/00* (2006.01)

(52) U.S. Cl.
CPC ..... *A63B 22/0694* (2013.01); *A47C 9/002* (2013.01); *A63B 2022/0641* (2013.01)

(58) Field of Classification Search
CPC ..... A63B 22/0605; A63B 22/0664; A63B 2022/0611; A63B 2022/0652
See application file for complete search history.

(56) References Cited

U.S. PATENT DOCUMENTS 3,455,295 A * 7/1969 Kellogg ..... A63B 22/001 482/904
4,973,046 A * 11/1990 Maxwell ..... A63B 22/0694 601/36
5,595,554 A * 1/1997 Maresh ..... A63B 21/157 482/52
7,438,672 B1 * 10/2008 Rylander ..... A63B 22/0605 482/61

(Continued)

FOREIGN PATENT DOCUMENTS

JP H10-94577 A 4/1998
JP 2004-261256 A 9/2004

(Continued)

OTHER PUBLICATIONS

PR Times, Introducing the large size model of the foot mobilization gear "BlackBoard Training System" that stabilizes the foot structure and improves the efficiency of lower limb movement, Press Release, (https://prtimes.jp/main/html/rd/p/000000016.000033723.html) Published on Apr. 22, 2023.

*Primary Examiner* — Zachary T Moore
(74) *Attorney, Agent, or Firm* — Dinsmore & Shohl LLP

(57) ABSTRACT

A rowing exercise device includes: a pair of pedals; and a device body that guides the pair of pedals in such a way that the pair of pedals repeatedly move along a predetermined trajectory. A user performs a lower limb exercise by putting his/her feet on the pair of respective pedals. Each pedal is configured in such a way that a relative roll turn of a forefoot part relative to the device body is prevented while a relative roll turn of a rearfoot part relative to the forefoot part is allowed, whereby a relative roll turn of the forefoot part relative to the rearfoot part occurs during the lower limb exercise.

17 Claims, 12 Drawing Sheets

(56) References Cited

U.S. PATENT DOCUMENTS

| | | | | |
|---|---|---|---|---|
| 11,583,719 | B2 * | 2/2023 | Weisz | A63B 23/03541 |
| 2004/0142797 | A1 * | 7/2004 | Andre | A63B 22/0694 482/57 |
| 2008/0161163 | A1 * | 7/2008 | Stewart | A63B 21/0051 482/51 |
| 2008/0318738 | A1 * | 12/2008 | Chen | A63B 21/015 482/57 |
| 2009/0197744 | A1 * | 8/2009 | Yamazaki | A63B 21/00181 482/57 |
| 2011/0275487 | A1 * | 11/2011 | Richards | B63B 34/50 482/57 |
| 2024/0139580 | A1 * | 5/2024 | Aoki | A63B 22/0694 |

FOREIGN PATENT DOCUMENTS

| | | | |
|---|---|---|---|
| JP | 4112574 | B2 | 7/2008 |
| JP | 5319110 | B2 | 10/2013 |

* cited by examiner

BELLOWS-TYPE BALLOON

COIL SPRING

LOWER LIMB EXERCISE DEVICE AND EXERCISE SYSTEM

CROSS REFERENCE TO RELATED APPLICATIONS

This application is based upon and claims the benefit of priority from Japanese patent application No. 2022-178771, filed on Nov. 8, 2022, the disclosure of which is incorporated herein in its entirety by reference.

BACKGROUND

The present disclosure relates to a lower limb exercise device and an exercise system.

Patent Literature 1 (Japanese Unexamined Patent Application Publication No. H10-94577) discloses a rowing exercise device.

SUMMARY

According to the configuration in Patent Literature 1, when a user performs a lower limb exercise, flexibility of feet cannot be improved.

An object of the present disclosure is to provide a technique for improving flexibility of feet when a user performs a lower limb exercise.

According to an aspect of the present disclosure, a lower limb exercise device including: a pair of pedals; and a device body that guides the pair of pedals in such a way that the pair of pedals repeatedly move along a predetermined trajectory, in which a user performs a lower limb exercise by putting his/her feet on the pair of respective pedals, and each pedal is configured in such a way that a relative roll turn of a forefoot part relative to the device body is prevented while a relative roll turn of a rearfoot part relative to the forefoot part is allowed, whereby a relative roll turn of the rearfoot part relative to the forefoot part occurs during the lower limb exercise is provided. According to the above configuration, it is possible to improve flexibility of feet when a user performs a lower limb exercise.

Each pedal may include a cup part that can accommodate the forefoot part and cannot carry out a roll turn relative to the device body; and tightening means for squeezing the cup part inward, in which the cup part is squeezed inward by the tightening means, whereby a relative roll turn of the forefoot part relative to the device body is prevented while a relative roll turn of the rearfoot part relative to the forefoot part is allowed. According to the above configuration, it is possible to provide pedals that improve flexibility of feet when a user performs a lower limb exercise in a simple configuration.

Each pedal may include: a front orthosis that can be attached to the forefoot part and cannot carry out a roll turn relative to the device body; a rear orthosis that can be attached to the rearfoot part; and a coupling part that couples the front orthosis to the rear orthosis in such a way that the front orthosis and the rear orthosis can carry out a roll turn relative to each other, and the front orthosis may be attached to the forefoot part and the rear orthosis may be attached to the rearfoot part, whereby a relative roll turn of the forefoot part relative to the device body is prevented while a relative roll turn of the rearfoot part relative to the forefoot part is allowed. According to the above configuration, it is possible to provide pedals that improve flexibility of feet when a user performs a lower limb exercise in a simple configuration.

Each pedal may include: a front plate on which the forefoot part can be mounted and which cannot carry out a roll turn relative to the device body; and a grip bar that is fixed to the front plate and can be gripped by a toe of the forefoot part, and the forefoot part may be placed on the front plate and the grip bar is gripped by the toe of the forefoot part, whereby a relative roll turn of the forefoot part relative to the device body is prevented while a relative roll turn of the rearfoot part relative to the forefoot part is allowed. According to the above configuration, it is possible to provide pedals that improve flexibility of feet when a user performs a lower limb exercise in a simple configuration.

Each pedal may be configured to allow a relative yaw turn of the forefoot part relative to the device body. According to the above configuration, it is possible to efficiently occur a motion linkage between lower limbs and the trunk.

An exercise system including: the lower limb exercise device described above; and a seat on which the user who performs the lower limb exercise using the lower limb exercise device sits, in which the seat is configured in such a way that the seat can carry out a roll turn relative to the device body is provided. According to the above configuration, it is possible to efficiently occur a motion linkage between lower limbs and the trunk.

The seat may be further configured in such a way that the seat can carry out a yaw turn relative to the device body. According to the above configuration, it is possible to efficiently occur a motion linkage between lower limbs and the trunk.

According to the present disclosure, flexibility of feet during a lower limb exercise is improved.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

First Embodiment

Hereinafter, with reference to FIGS. 1 to 5, a first embodiment of the present disclosure will be described.

Figure 1:
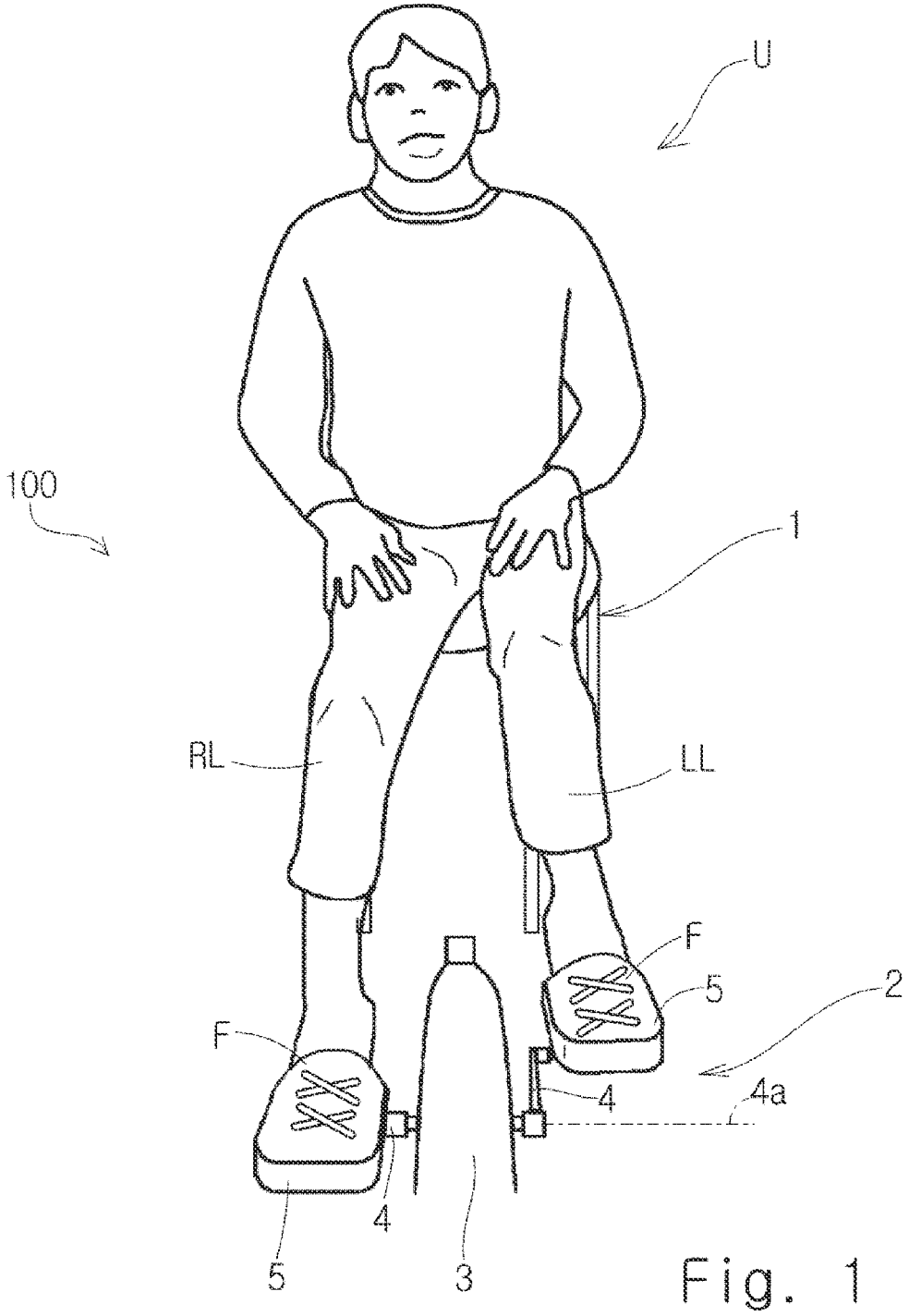
FIG. 1 is a diagram showing a state in which a user who is sitting is performing a rowing exercise using a rowing exercise device (first embodiment)

FIG. 1 shows an exercise system 100. As shown in FIG. 1, an exercise system 100 includes a chair 1 and a rowing exercise device 2. A user U performs a rowing exercise using the rowing exercise device 2 in a state in which the user U is sitting on the chair 1.

The rowing exercise device 2 is one specific example of a lower limb exercise device that achieves a lower limb exercise including repetitive extension and flexion of knee joints, hip joints, and ankle joints. Therefore, the rowing exercise is one specific example of a lower limb exercise. The rowing exercise device 2 includes a device body 3 placed on a floor where the rowing exercise device 2 is installed, a pair of cranks 4, and a pair of pedals 5. The pair of pedals are provided in the pair of respective cranks 4 in such a way that the pedals 5 can carry out a pitch turn. The pair of cranks 4 are provided in such a way that they can carry out a pitch turn by the device body 3. The user U performs a rowing exercise by putting his/her feet F on the pair of respective pedals 5 in a state in which he/she is sitting on the chair 1 and alternately stepping with his/her right leg RL and left leg LL. At this time, extension and flexion of the knee joints, the hip joints, and the ankle joints of the right leg RL and the left leg LL are repeated. In general, when the knee joint of the right leg RL is extended, the knee joint of the left leg LL is flexed. When the hip joint of the right leg RL is extended, the hip joint of the left leg LL is flexed. When the ankle joint of the right leg RL is extended, the ankle joint of the left leg LL is flexed. Accordingly, the pair of pedals 5 are rotated about a crank shaft 4*a* in phases opposite to each other. That is, the rowing exercise device 2 achieves a lower limb exercise in which both feet F draw a circular trajectory about the crank shaft 4*a*. In other words, the device body 3 guides the pair of pedals 5 in such a way that the pair of pedals 5 repeatedly move along the circular trajectory. The circular trajectory is one specific example of a predetermined trajectory.

Note that the rowing exercise device 2 is merely one example of a lower limb exercise device. That is, the lower limb exercise device is not limited to the rowing exercise device 2. The lower limb exercise device may be the one that achieves a lower limb exercise in which the user U who is sitting on the chair 1 moves his/her both feet F back and forth along a straight line trajectory parallel to the floor surface. The straight line trajectory is one specific example of a predetermined trajectory. The lower limb exercise device may achieve a lower limb exercise while the user U keeps his/her standing posture.

Hereinafter, the chair 1 will be described first and then each pedal 5 will be described in detail.

(Chair 1)

Figure 2:
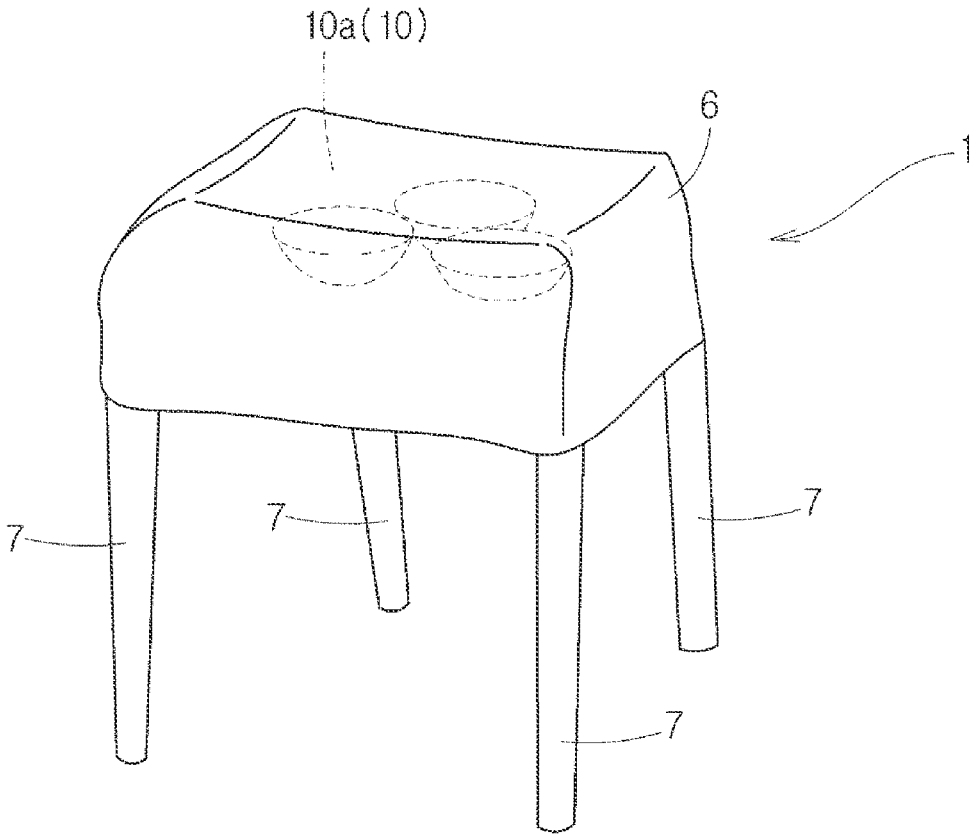
FIG. 2 is a perspective view of a chair (first embodiment)

FIG. 2 shows a perspective view of the chair 1. As shown in FIG. 2, the chair 1 includes a main body 6 of the chair and a plurality of legs 7. The main body 6 of the chair is supported by the plurality of legs 7.

Figure 3:
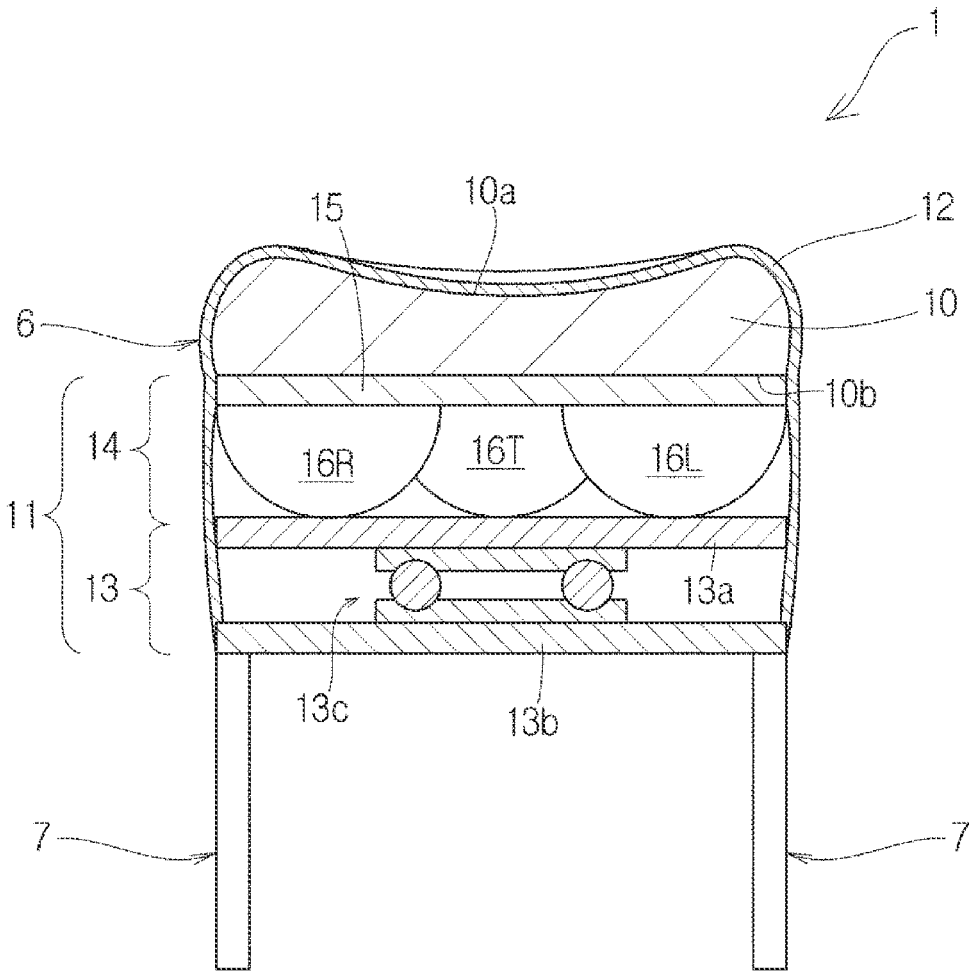
FIG. 3 is a front cross-sectional view of the chair (first embodiment)

FIG. 3 shows a front cross-sectional view of the chair 1. As shown in FIG. 3, the main body 6 of the chair includes a seat 10, a support mechanism 11 that supports the seat 10, and a cover 12. The support mechanism 11 is disposed under (inferior to) the seat 10. That is, the seat 10 is disposed above (superior to) the support mechanism 11.

The seat 10 is a part on which the user U sits. The seat 10 includes a seating surface 10*a* that faces upward and a lower surface 10*b* that faces downward. As shown in FIGS. 2 and 3, the seating surface 10*a* is slightly tilted in such a way that it is elevated toward the back (posterior). The seat 10 is formed of a soft material that is suitable for distributing the pressure between the user U when the user U sits thereon and the seat 10. In general, the seat 10 is a continuous air bubble structure such as urethane foam or an independent air bubble structure such as polyethylene foam or rubber sponge.

A concave part for positioning the pelvis of the user U who sits on the seat relative to the seat 10 may be formed in the seat 10. In general, the concave part is formed so as to accommodate the hip, the right thigh, and the left thigh of the user. Alternatively, a line for indicating the position of the hip of the user U who sits on the seat 10 may be drawn in the seat 10. Accordingly, it is possible to achieve a desirable positional relation between the seat 10 and the pelvis of the user U.

The support mechanism 11 is a mechanism that supports the seat 10 in such a manner that the seat 10 can carry out a roll oscillation and a yaw oscillation. The support mechanism 11 includes a yaw oscillation mechanism 13 and a roll oscillation mechanism 14. The roll oscillation mechanism 14 is disposed over the yaw oscillation mechanism 13. Alternatively, the roll oscillation mechanism 14 may be disposed under the yaw oscillation mechanism 13. Alternatively, the yaw oscillation mechanism 13 may be omitted.

The yaw oscillation mechanism 13 includes an upper support plate 13*a* disposed in an upper part of the yaw oscillation mechanism 13, a lower support plate 13*b* disposed in a lower part of the yaw oscillation mechanism 13, and a bearing 13*c* disposed between the upper support plate 13*a* and the lower support plate 13*b*. That is, the upper support plate 13*a* is disposed over the bearing 13*c* and the lower support plate 13*b* is disposed under the bearing 13*c*. The plurality of legs 7 are fixed to the lower support plate 13*b* in such a way that these legs 7 are protruded downward from the lower support plate 13*b*. The upper support plate 13*a* is able to carry out a yaw oscillation relative to the lower support plate 13*b* by the bearing 13*c*. In this embodiment, the bearing 13*c* is a rolling bearing. Alternatively, the bearing 13*c* may be a sliding bearing. The upper support plate 13*a* and the lower support plate 13*b*, which are plates having a sufficiently high rigidity so that they do not easily bend under a load such as the one applied by the user U, are made of, for example, wood, metal, or resin.

The roll oscillation mechanism 14 includes an upper support plate 15 disposed in an upper part of the roll oscillation mechanism 14 and a plurality of balloons 16R, 16T, and 16L, collectively referred to as balloons 16, disposed in a lower part of the roll oscillation mechanism 14. That is, the upper support plate is disposed over the plurality of balloons 16. The plurality of balloons 16 are disposed under the upper support plate 15. The upper support plate 15, which is a plate having a sufficiently high rigidity so that it does not easily bend under a load such as the one applied by the user U, is made of, for example, wood, metal, or resin. The upper support plate 15 is disposed on the lower surface 10*b* of the seat 10, whereby it is possible to prevent the seat 10 from being curved so as to be convex downward when the user U sits on the seat 10.

Each balloon 16 is one specific example of an elastic body that may generate a repulsive force upward when it is compressed in the vertical direction. Each balloon 16 is one specific example of a bag body in which gas is enclosed. That is, each balloon 16 is swollen as gas is enclosed therein under a predetermined pressure and thus exhibits a predetermined shape. In this embodiment, each balloon 16 has a hemispherical shape that is convex downward in a state in which the gas is enclosed therein. In general, each balloon 16 is made of vinyl chloride resin.

The plurality of balloons 16 include a right ischium balloon 16R, a left ischium balloon 16L, and a coccyx balloon 16T. The right ischium balloon 16R, which is disposed under the seat 10, is one specific example of a right-leg-side elastic body that corresponds to a right-leg-side ischium, which is the ischium on the right leg side of the user U who sits on the seat 10. The left ischium balloon 16L, which is disposed under the seat 10, is one specific example of a left-leg-side elastic body that corresponds to a left-leg-side ischium, which is the ischium on the left leg side of the user U who sits on the seat 10. The coccyx balloon 16T, which is disposed under the seat 10, is one specific example of a coccyx elastic body that corresponds to the coccyx of the user U who sits on the seat 10.

Figure 4:
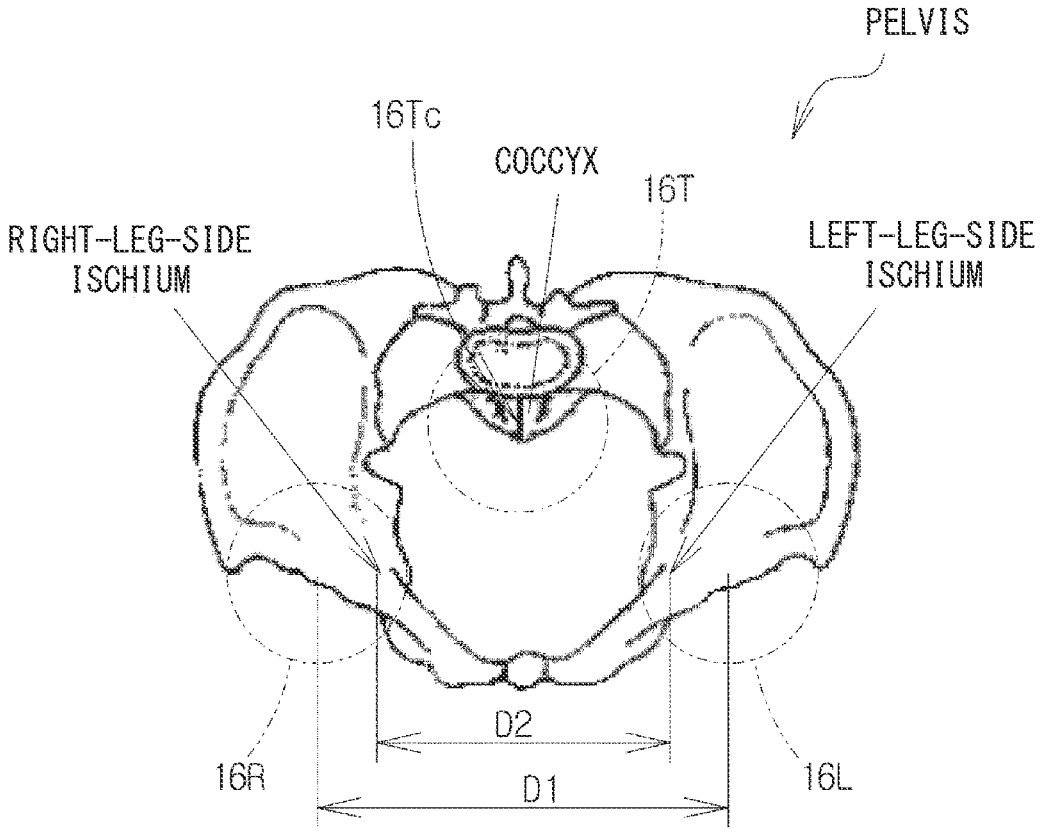
FIG. 4 is a plan view of a pelvis (first embodiment)

FIG. 4 shows a plan view of the pelvis of the user U when the user U sits on the seat 10. The right ischium balloon 16R is disposed so as to correspond to the right-leg-side ischium of the user U who sits on the seat 10. The left ischium balloon 16L is disposed so as to correspond to the left-leg-side ischium of the user U who sits on the seat 10. The coccyx balloon 16T is disposed so as to correspond to the coccyx of the user U who sits on the seat 10.

Further specifically, in the plan view shown in FIG. 4, a distance D1 between the center of the right ischium balloon 16R and the center of the left ischium balloon 16L is larger than a distance D2 between the lower end of the right-leg-side ischium and the lower end of the left-leg-side ischium. That is, in the plan view shown in FIG. 4, the right ischium balloon 16R is disposed slightly outside (lateral) of the lower end of the right-leg-side ischium. Likewise, the left ischium balloon 16L is disposed slightly outside of the lower end of the left-leg-side ischium. With this arrangement, a repulsive force of the right ischium balloon 16R when the pelvis rolls to the right side efficiently pushes back the pelvis so that the pelvis rolls to the left side. Likewise, a repulsive force of the left ischium balloon 16L when the pelvis rolls to the left side efficiently pushes back the pelvis so that the pelvis rolls to the right side. Accordingly, it is possible to rhythmically roll the pelvis alternately to the right and the left with a small load for the user U. Alternatively, the right ischium balloon 16R may be disposed immediately below the lower end of the right-leg-side ischium and the left ischium balloon 16L may be provided immediately below the lower end of the left-leg-side ischium.

As described above, by providing the right ischium balloon 16R and the left ischium balloon 16L, when the user U sits on the seat 10 and performs a rowing exercise using the rowing exercise device 2, the pelvis of the user U carries out a roll turn to the right and left, whereby an ascending motion linkage from the lower limb to the trunk will occur, whereby it is possible for the user to perform training of not only his/her lower limbs but also the trunk thereof. That is, the exercise of the trunk muscles represented by the rectus abdominis, transversus abdominis, and erector spinae will be achieved simultaneously. Here, the roll turn of the pelvis of the user U means that the right-leg-side ischium becomes relatively lower than the left-leg-side ischium or the right-leg-side ischium becomes relatively higher than the left-leg-side ischium.

On the other hand, as shown in FIG. 4, the coccyx balloon 16T is disposed immediately below the lower end of the coccyx. That is, a center 16Tc of the coccyx balloon 16T is positioned immediately below the lower end of the coccyx. Alternatively, the center 16Tc of the coccyx balloon 16T may be positioned anterior to the lower end of the coccyx or may be disposed posterior to the lower end of the coccyx in a plan view shown in FIG. 4. In short, it is sufficient that the coccyx balloon 16T be disposed posterior to the right ischium balloon 16R and the left ischium balloon 16L. According to the aforementioned configuration, the coccyx balloon 16T is able to support the seat 10 so that the pitch posture of the seat 10 is made stable.

In order to efficiently generate an ascending motion linkage from the lower limb to the trunk, it is important that the pitch posture of the pelvis be slightly tilted forward. There may be various methods for correcting the pitch posture of the pelvis. The first method is, for example, to make the internal pressure of the coccyx balloon 16T higher than the internal pressure of the right ischium balloon 16R and that of the left ischium balloon 16L. According to the aforementioned configuration, when the user U sits on the seat 10, the front part of the seat 10 sinks and the back part of the seat 10 hardly sinks, whereby the pitch posture can be corrected. The second method is to form the seat 10 in such a way that the seating surface 10*a* of the seat 10 rises toward the back, as shown in FIG. 2. According to the aforementioned configuration, the seating surface 10*a* itself rises toward the back, whereby the pitch posture can be corrected. The first method and the second method may be combined with each other.

Referring once again to FIG. 3, the cover 12, which covers the seat 10 and the support mechanism 11, is generally made of cloth.

(Each Pedal 5)

Figure 5:
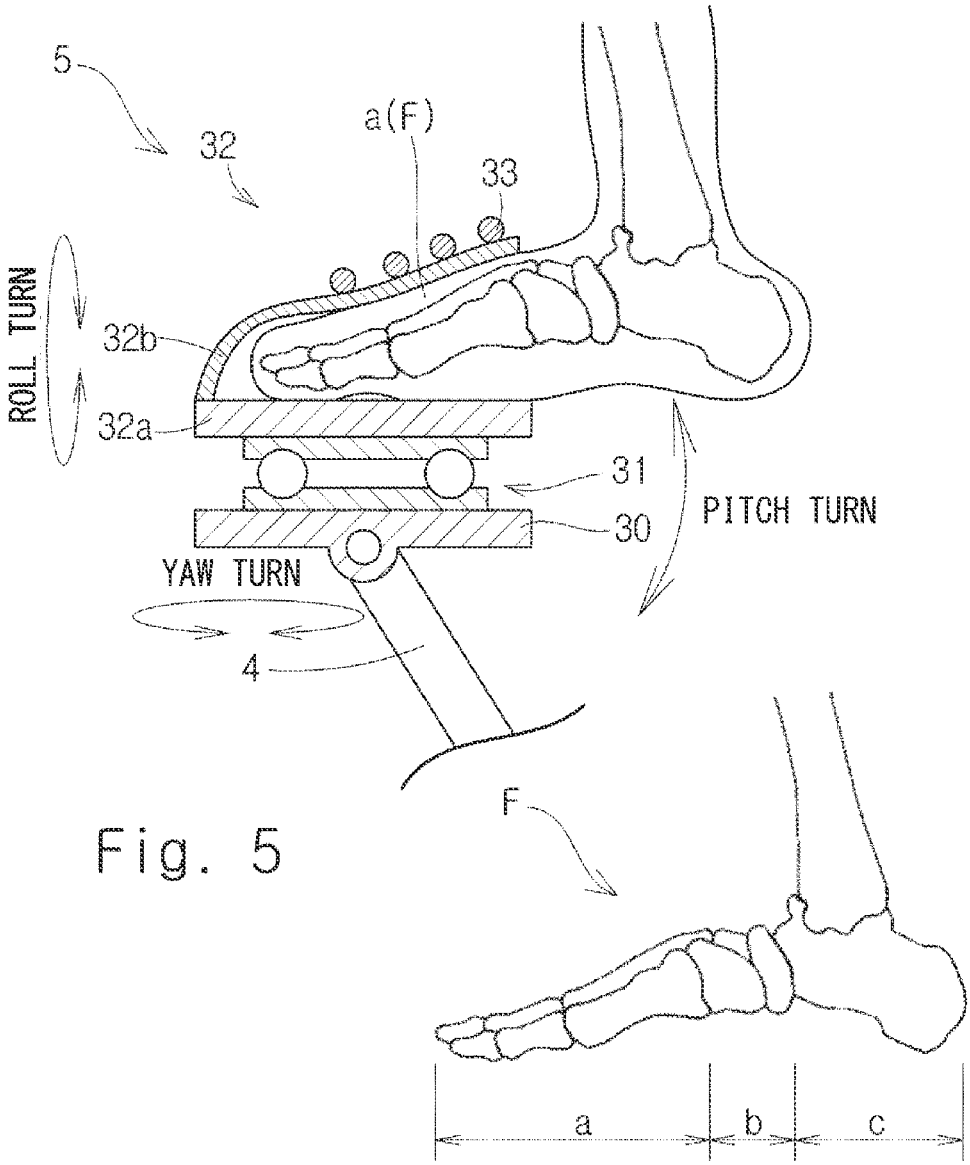
FIG. 5 is a side cross-sectional view of the pedal (first embodiment)

Referring next to FIG. 5, each pedal 5 will be described. FIG. 5 also shows the skeleton of the foot F as well. As shown in FIG. 5, the foot F is divided into three main parts, i.e., a forefoot part a, a midfoot part b, and a rearfoot part c. The forefoot part a has metatarsal bones and phalanges. The midfoot part b has tarsal bones. The rearfoot part c has the talus and calcaneus. Then, each pedal 5 is configured to prevent a relative roll turn of the forefoot part a relative to the device body 3 and to allow a relative roll turn of the rearfoot part c relative to the forefoot part a. The roll turn of the forefoot part a here means a turn of the forefoot part a with a foot-length direction of the foot F as a turning axis. Therefore, even if the foot-length direction of the foot F becomes a vertical direction, a turn of the forefoot part a with the foot-length direction of the foot F as the turning axis is defined to be a roll turn.

Each pedal 5 includes a base 30, a bearing 31, a cup part 32, and a shoelace 33.

The base 30 is coupled to the tip of the crank 4 in such a way that the base can carry out a pitch turn.

The bearing 31, which is disposed between the base 30 and the cup part 32, couples the base 30 to the cup part 32 in such a way that the base 30 and the cup part 32 can carry out a yaw turn relative to each other.

The cup part 32 is a part that accommodates the forefoot part a of the foot F. The cup part 32 includes an outer sole 32*a* fixed to the bearing 31 and a cover 32*b* that covers the forefoot part a placed on the outer sole 32*a*. The cover 32*b*, which is a member having flexibility and elasticity, is generally made of cloth.

The shoelace 33 is one specific example of tightening means for squeezing the cup part 32 inward. By squeezing the cup part 32 inward using the shoelace 33, the forefoot part a can be restrained. That is, the forefoot part a is fixed to the cup part 32. Accordingly, a relative roll turn of the forefoot part a relative to the device body 3 is prevented.

On the other hand, as shown in FIG. 5, the midfoot part b and the rearfoot part c of the foot F are not accommodated in the cup part 32. Therefore, even after the cup part 32 is squeezed inward using the shoelace 33, the midfoot part b and the rearfoot part c are not fixed to the cup part 32. Accordingly, a relative roll turn of the rearfoot part c relative to the forefoot part a is allowed. The relative roll turn of the rearfoot part c relative to the forefoot part a means a turn of the rearfoot part c relative to the forefoot part a with the foot-length direction of the foot F as the turning axis.

When the user U performs a rowing exercise using the rowing exercise device 2, a roll turn of the forefoot part a is prevented, while a roll turn of the rearfoot part c is allowed, which causes a relative roll turn of the rearfoot part c relative to the forefoot part a in association with the movement of the lower limb. Accordingly, flexibility of the feet F is improved. The improved flexibility of the feet F improves the balance of the user U when he/she walks on an uneven ground; that is, the ability to appropriately maintain a posture while walking. Further, the improved flexibility of the feet F contributes to forming of the medial longitudinal arch of the foot F. The medial longitudinal arch of the foot F has a function of absorbing the shock at a time of walking and reducing the burden on the knee.

While the first embodiment has been described above, the above first embodiment has the following features.

That is, the rowing exercise device 2 (lower limb exercise device) includes the pair of pedals 5 and the device body 3 that guides the pair of pedals 5 in such a way that the pair of pedals 5 repeatedly move along a predetermined trajectory. The user U performs a rowing exercise (lower limb exercise) by putting his/her feet F on the pair of respective pedals 5. Each pedal 5 is configured in such a way that a relative roll turn of the forefoot part a relative to the device body 3 is prevented while a relative roll turn of the rearfoot part c relative to the forefoot part a is allowed, whereby a relative roll turn of the rearfoot part a relative to the forefoot part c occurs during the rowing exercise. According to the above configuration, flexibility of the feet F during the rowing exercise is improved.

Further, each pedal 5 includes the cup part 32 that can accommodate the forefoot part a and cannot carry out a roll turn relative to the device body 3, and the shoelace 33 (tightening means) for squeezing the cup part 32 inward. By squeezing the cup part 32 inward by the shoelace 33, a relative roll turn of the forefoot part a relative to the device body 3 is prevented while a relative roll turn of the rearfoot part c relative to the forefoot part a is allowed. According to the above configuration, it is possible to provide pedals 5 that improve flexibility of the feet F during the rowing exercise in a simple configuration. Note that each pedal 5 may include an instep band that restrains the forefoot part a in the base 30 instead of the cup part 32 that accommodates the forefoot part a.

Further, each pedal 5 is configured to allow a relative yaw turn of the forefoot part a relative to the device body 3. That is, as shown in FIG. 5, each pedal 5 includes the bearing 31, whereby a relative yaw turn of the forefoot part a relative to the device body 3 is allowed. The yaw turn of the forefoot part a means a turn with a direction perpendicular to both the roll turning axis of the foot F and the pitch turning axis of the pedal 5 with respect to the crank 4 as the turning axis. According to the above configuration, it is possible to efficiently occur a motion linkage between lower limbs and the trunk.

Further, the exercise system 100 includes the rowing exercise device 2, and the seat 10 on which the user U who performs a rowing exercise using the rowing exercise device 2 sits. The seat 10 is configured in such a way that it can carry out a roll turn. According to the above configuration, since the seat 10 carries out a roll oscillation during the rowing exercise, a motion linkage between lower limbs and the trunk occurs, whereby it is possible to achieve a motion linkage between lower limbs and the trunk when a user who is in a sitting posture performs the rowing exercise. The motion linkage between lower limbs and the trunk means an ascending motion linkage from lower limbs to the trunk.

That is, since the seat 10 is configured in such a way that the seat 10 can carry out a roll turn, when the user U sits on the seat 10 and performs a rowing exercise using the rowing exercise device 2, the pelvis of the user U carries out a roll turn to the right and left, whereby an ascending motion linkage from the lower limbs to the trunk will occur and it is possible for the user U to perform training of not only his/her lower limbs but also the trunk thereof. That is, the exercise of the trunk muscles represented by the rectus abdominis, transversus abdominis, and erector spinae will be achieved simultaneously.

Further, the seat 10 is further configured in such a way that the seat 10 can carry out a yaw turn. The yaw turn of the seat 10 means a turn with a direction perpendicular to the plane where the rowing exercise device 2 is installed as the turning axis. According to the above configuration, when the user U who sits on the seat 10 performs a rowing exercise using the rowing exercise device 2, a yaw turn of the pelvis of the user U is allowed, whereby it is possible to cause the aforementioned motion linkage to occur more efficiently.

The exercise system 100 shown in FIG. 1 includes the rowing exercise device 2 (lower limb exercise device) and the chair 1. The rowing exercise device 2 achieves a lower limb exercise which includes repetitive extension and flexion of at least knee joints and hip joints. The chair 1 is the one on which the user U who performs the lower limb exercise using the rowing exercise device 2 sits. As shown in FIG. 3, the chair 1 includes the seat 10 on which the user U sits and the support mechanism 11 that supports the seat 10 in such a manner that the seat 10 can carry out a roll oscillation. Since the seat 10 carries out a roll oscillation during the lower limb exercise, a motion linkage between lower limbs and the trunk occurs. According to the aforementioned configuration, it is possible to achieve a motion linkage between lower limbs and the trunk when a user who is in a sitting posture performs a lower limb exercise.

As shown in FIGS. 3 and 4, the support mechanism 11 includes the right ischium balloon 16R (right-leg-side elastic body) that is disposed under the seat 10 and corresponds to a right-leg-side ischium, which is the ischium on the right leg side of the user U who sits on the seat 10, and the left ischium balloon 16L (left-leg-side elastic body) that is disposed under the seat 10 and corresponds to a left-leg-side ischium, which is the ischium on the left leg side of the user U who sits on the seat 10. According to the aforementioned configuration, the support mechanism 11 may be provided with a simple configuration.

Further, the right ischium balloon 16R and the left ischium balloon 16L are bag bodies in which gas is enclosed. According to the aforementioned configuration, an inexpensive exercise system 100 may be provided.

Further, as shown in FIG. 3, the right ischium balloon 16R and the left ischium balloon 16L have a hemispherical shape that is convex downward in a state in which gas is enclosed therein. According to the aforementioned configuration, an effective roll oscillation may be carried out.

The support mechanism 11 further corrects the pitch posture of the pelvis of the user U. According to the aforementioned configuration, it is possible to efficiently occur an ascending motion linkage from the lower limbs to the trunk.

Further, as shown in FIG. 3, the support mechanism 11 is disposed under the seat 10 and further includes the coccyx balloon 16T as a coccyx elastic body that corresponds to the coccyx of the user U who sits on the seat 10. The pitch posture of the pelvis of the user U is corrected by the coccyx balloon 16T. According to the aforementioned configuration, the support mechanism 11 may be provided with a simple configuration.

Further, the coccyx balloon 16T, which is a coccyx elastic body, is a bag body in which gas is enclosed. According to the aforementioned configuration, it is possible to provide an inexpensive coccyx elastic body.

Second Embodiment

Figure 6:
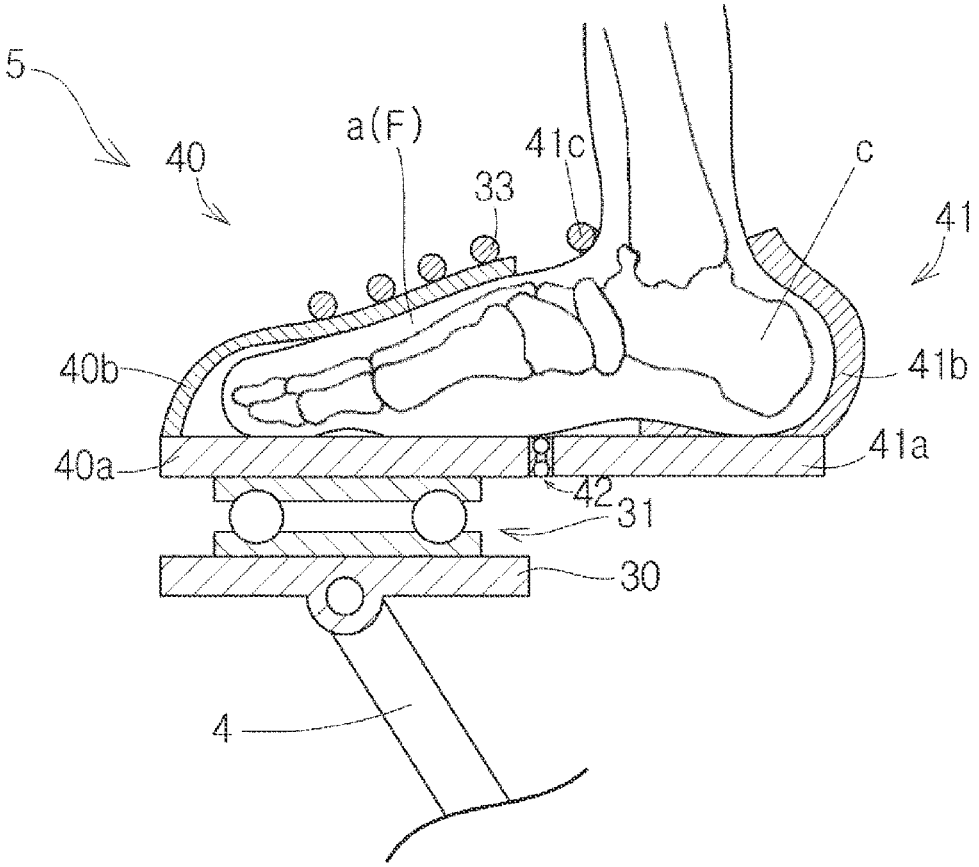
FIG. 6 is a side cross-sectional view of a pedal (second embodiment)

Referring next to FIG. 6, a second embodiment will be described. Hereinafter, differences between this embodiment and the first embodiment will be mainly described, and redundant descriptions will be omitted.

As shown in FIG. 6, a pedal 5 according to this embodiment can be attached to a forefoot part a and includes a front cup part 40, which is a front orthosis that cannot carry out a roll turn relative to the device body 3, a back cup part 41, which is a rear orthosis that can be attached to a rearfoot part c, and a coupling part 42 that couples the front cup part 40 to the back cup part 41 in such a way that the front cup part 40 and the back cup part 41 can relatively carry out a roll turn.

The front cup part 40 has a configuration similar to that of the cup part 32 according to the first embodiment. That is, the front cup part 40 includes an outer sole 40*a* and a cover 40*b*. The outer sole 40*a* corresponds to the outer sole 32*a* of the cup part 32. The cover 40*b* corresponds to the cover 32*b* of the cup part 32.

The back cup part 41 includes an outer sole 41*a* on which the rearfoot part c is placed, a cover 41*b* that covers the rearfoot part c placed on the outer sole 41*a*, and a band 41*c* for maintaining a state in which the outer sole 41*a* and the cover 41*b* are attached to the rearfoot part c.

The coupling part 42 couples the outer sole 40*a* of the front cup part 40 to the outer sole 41*a* of the back cup part 41, which are adjacent to each other in the foot-length direction of a foot F, in such a way that the outer sole 40*a* of the front cup part 40 and the outer sole 41*a* of the back cup part 41 can carry out a roll turn relative to each other. The outer sole 40*a* of the front cup part 40 and the outer sole 41*a* of the back cup part 41 being able to carry out a roll turn relative to each other specifically mean that the outer sole 40*a* of the front cup part 40 and the outer sole 41*a* of the back cup part 41 turning relative to each other with the foot-length direction of the foot F as the turning axis. The coupling part 42 may generally be achieved by a rolling bearing or a sliding bearing. The coupling part 42 may be made of any material that can achieve the aforementioned relative turn. Therefore, the coupling part 42 may be an elastic body having a sufficiently high flexibility. In some embodiments, the coupling part 42 may prevent a relative pitch turn and a relative yaw turn of the outer sole 40*a* of the front cup part 40 and the outer sole 41*a* of the back cup part 41.

According to the above configuration, the front cup part 40 is attached to the forefoot part a and the back cup part 41 is attached to the rearfoot part c, whereby the relative roll turn of the forefoot part a relative to the device body 3 is prevented while the relative roll turn of the rearfoot part c relative to the forefoot part a is allowed. According to the above configuration, it is possible to achieve pedals 5 that improve flexibility of the feet F in a simple configuration.

Third Embodiment

Figure 7:
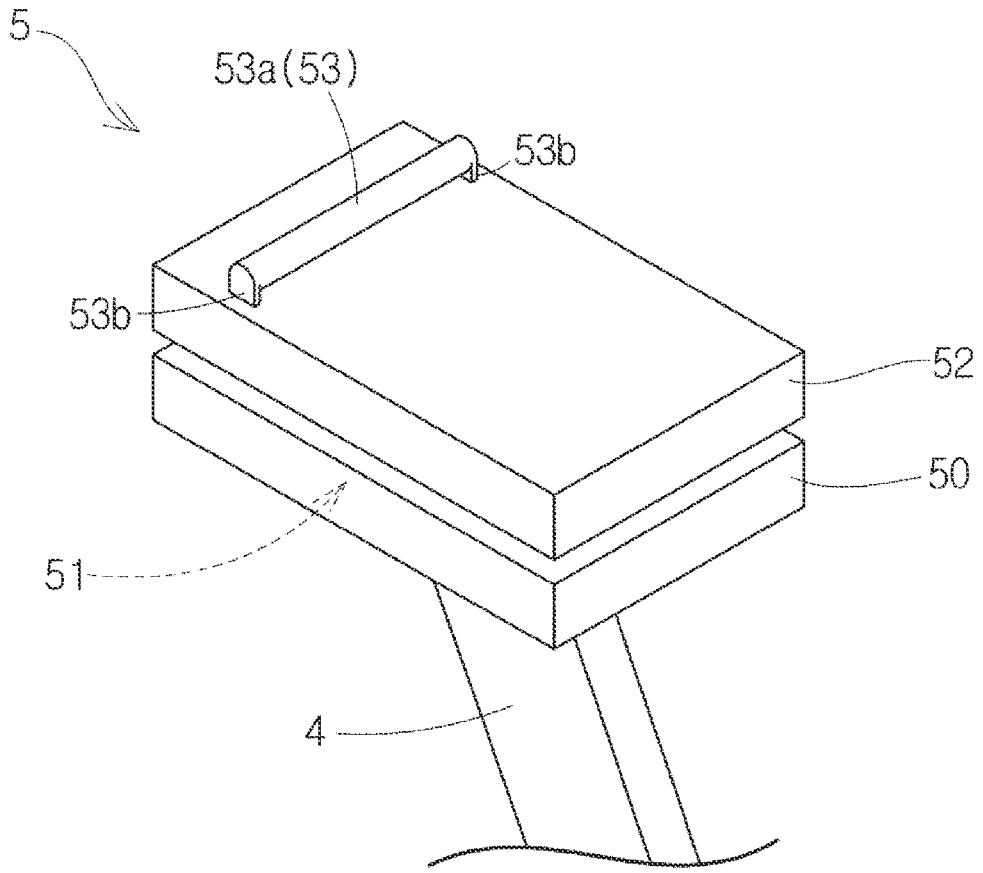
FIG. 7 is a perspective view of a pedal (third embodiment)

Referring next to FIG. 7, a third embodiment will be described. Hereinafter, differences between this embodiment and the first embodiment will be mainly described, and redundant descriptions will be omitted.

Figure 8:
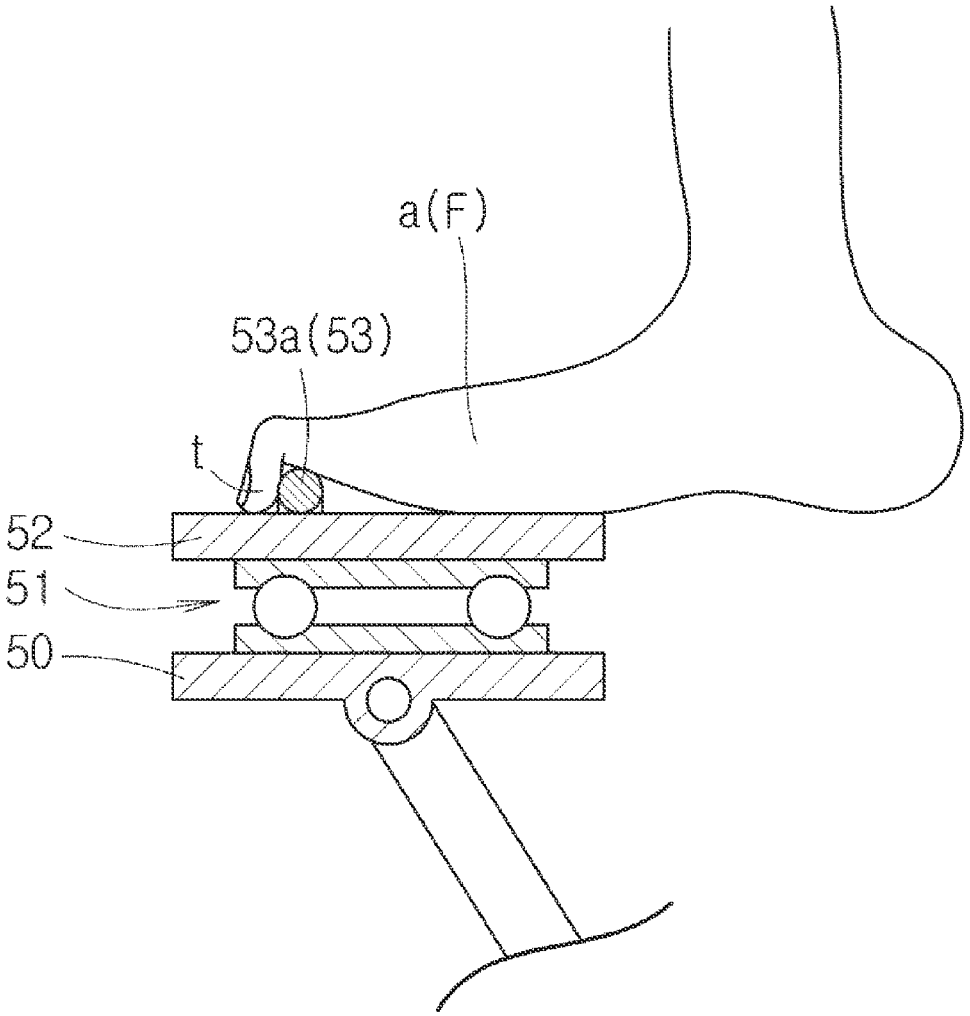
FIG. 8 is a side cross-sectional view of the pedal (third embodiment)

As shown in FIGS. 7 and 8, a pedal 5 according to this embodiment includes a base 50, a bearing 51, a front plate 52, and a grip bar 53.

The base 50 is coupled to the tip of the crank 4 in such a way that the base 50 can carry out a pitch turn.

The bearing 51, which is disposed between the base 50 and the front plate 52, couples the base 50 to the front plate 52 in such a way that the base 50 and the front plate 52 can carry out a yaw turn relative to each other.

The front plate 52 is a part on which a forefoot part a of a foot F can be mounted. The front plate 52 is configured in such a way that it cannot carry out a roll turn relative to a device body 3. The roll turn here means a turn with the foot-length direction of the foot F when the forefoot part a is placed on the front plate 52 as the turning axis.

The grip bar 53 includes a bar body 53*a* and a pair of leg parts 53*b*. The bar body 53*a*, which is extended substantially in parallel to the pitch turning axis of the base 50, is fixed to the front plate 52 via the pair of leg parts 53*b*. The grip bar 53 is provided on the tip side of the front plate 52. Then, the bar body 53*a* of the grip bar 53 is disposed above the front plate 52 with some space therebetween. Therefore, as shown in FIG. 8, the bar body 53*a* can be gripped by the toe t of the forefoot part a. On the other hand, a rearfoot part c is by no means restrained by the pedal 5. According to this configuration, the forefoot part a is placed on the front plate 52 and the bar body 53*a* of the grip bar 53 is gripped by the toe t of the forefoot part a, whereby a configuration in which a relative roll turn of the forefoot part a relative to the device body 3 is prevented while a relative roll turn of the rearfoot part c relative to the forefoot part a is allowed is provided.

While the third embodiment has been described above, the above third embodiment has the following features.

That is, as shown in FIGS. 7 and 8, each pedal 5 includes the front plate 52 on which the forefoot part a can be mounted and that cannot carry out a roll turn relative to the device body 3, and the grip bar 53 that is fixed to the front plate 52 and can be gripped by the toe t of the forefoot part a. The forefoot part a is placed on the front plate 52 and the grip bar 53 is gripped by the toe t of the forefoot part a, whereby a relative roll turn of the forefoot part a relative to the device body 3 is prevented while a relative roll turn of the rearfoot part c relative to the forefoot part a is allowed. According to the above configuration, it is possible to provide pedals 5 that improve flexibility of the feet F in a simple configuration.

Modified Example

Each of the above embodiments can be changed as follows.

That is, in each of the above embodiments, as shown in FIG. 3, the chair 1 itself includes the seat 10 and the support mechanism 11.

Figure 9:
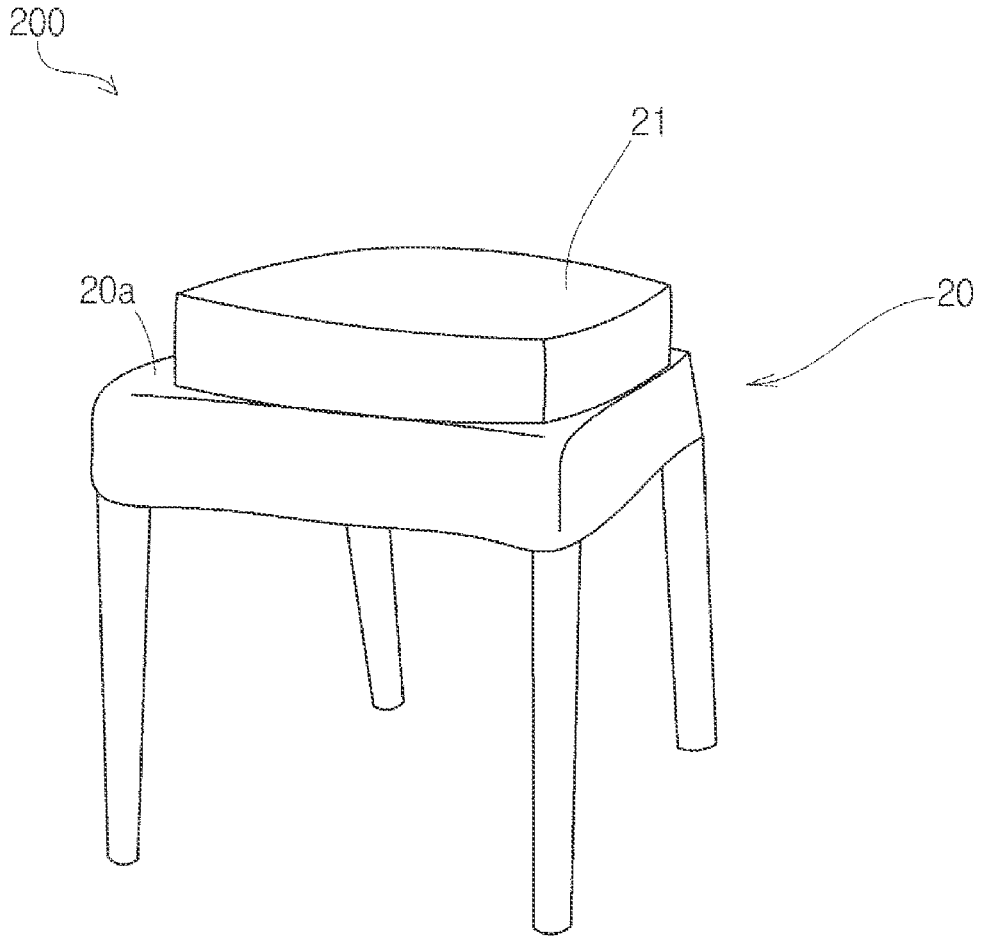
FIG. 9 is a perspective view of a chair (modified example)
Figure 10:
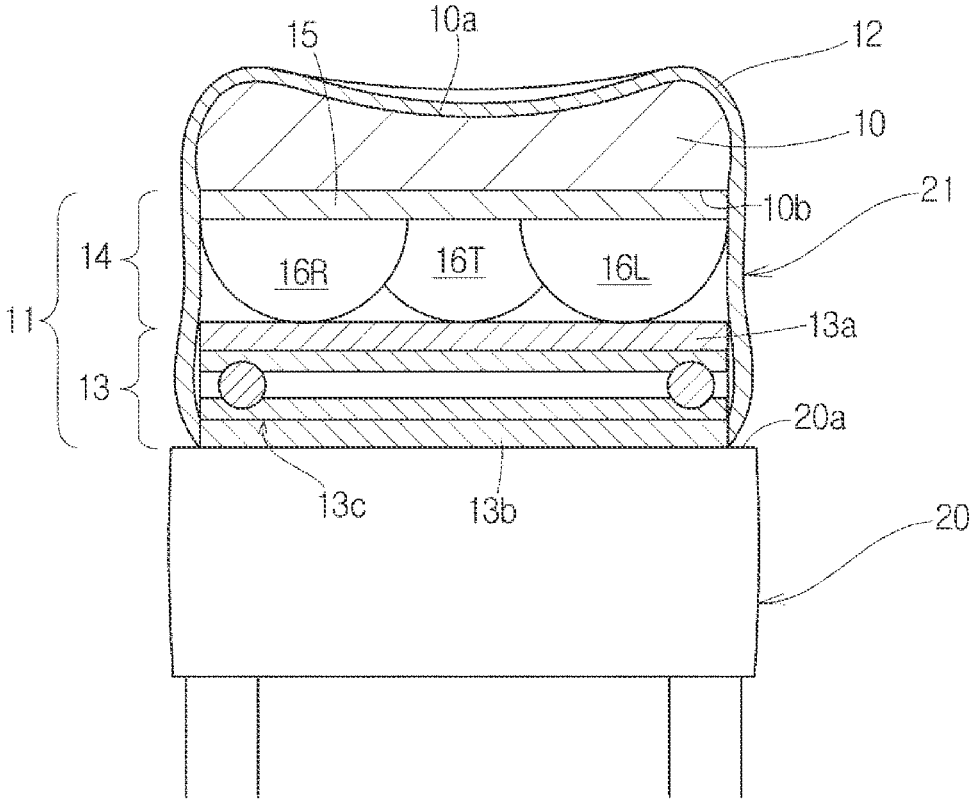
FIG. 10 is a front cross-sectional view of the chair (modified example)

On the other hand, as shown in FIGS. 9 and 10, an exercise assisting tool 21 that can be applied to an existing chair 20 may include a seat 10 and a support mechanism 11.

That is, the exercise assisting tool 21 is mounted on a seating surface 20*a* of the chair 20 for use. Specifically, as shown in FIG. 10, the exercise assisting tool 21 is mounted on the seating surface 20*a* of the chair 20 in such a way that a lower support plate 13*b* of a yaw oscillation mechanism 13 of the support mechanism 11 included in the exercise assisting tool 21 is opposed to the seating surface 20*a* of the chair 20 in the vertical direction.

In short, the above-described modified example has the following features.

As shown in FIGS. 9 and 10, an exercise system 200 includes a rowing exercise device 2, and the exercise assisting tool 21 that can be mounted on the seating surface 20*a* of the chair 20 and on which a user U who performs a rowing exercise using the rowing exercise device 2 sits. The exercise assisting tool 21 includes the seat 10 on which the user U sits and the support mechanism 11 that supports the seat 10 in such a manner that the seat 10 can carry out a roll oscillation. Since the seat 10 carries out a roll oscillation during the lower limb exercise, a motion linkage between lower limbs and the trunk occurs. According to the above configuration, it is possible to achieve a motion linkage between lower limbs and the trunk when a user who is in a sitting posture performs a lower limb exercise.

Figure 11:
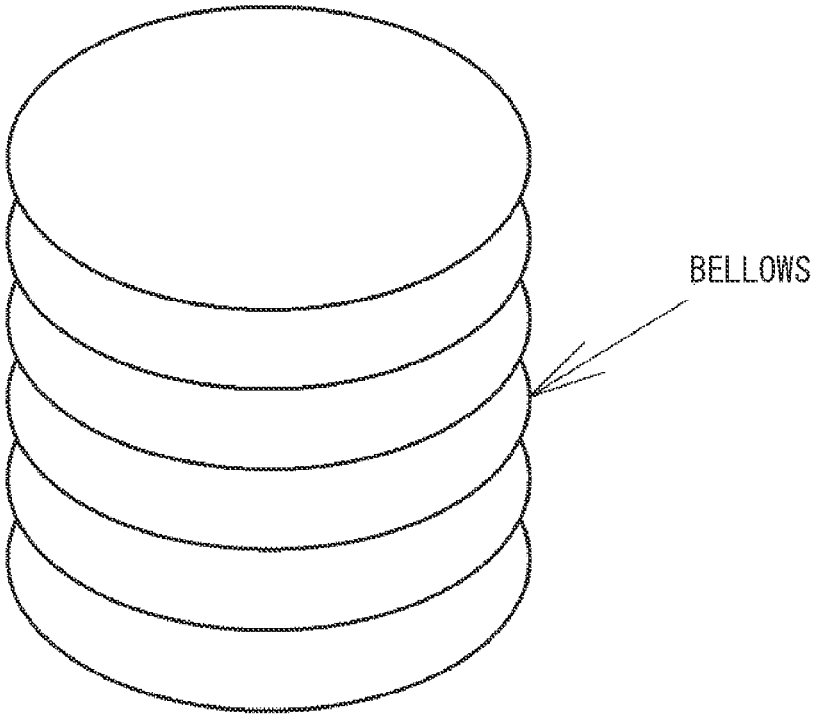
FIG. 11 is a front view of a bellows-type balloon (modified example)
Figure 12:
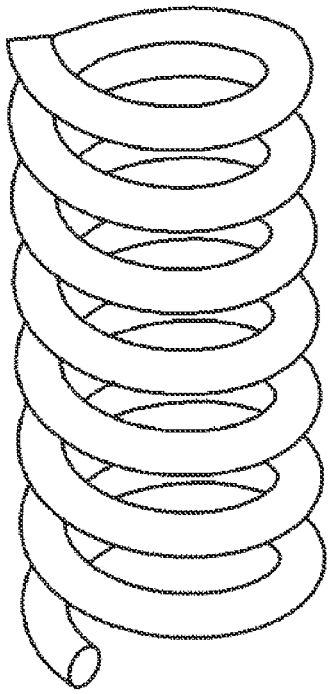
FIG. 12 is a front view of a coil spring (modified example).

That is, as shown in FIGS. 3 and 10, in each of the above embodiments, each balloon 16 has a hemispherical shape that is convex downward in a state in which gas is enclosed therein. Alternatively, as shown in FIG. 11, each balloon 16 may be a bellows-type balloon having bellows in an outer peripheral part in such a way that it can be extended and retracted in the longitudinal direction. In this case, each balloon 16 may be disposed in such a way that its longitudinal direction is the vertical direction. Further, instead of each balloon 16, a coil spring may be employed, as shown in FIG. 12. In this case, the coil spring may be disposed in such a way that its longitudinal direction is the vertical direction. The coil spring that is disposed instead of the right ischium balloon 16R may be disposed obliquely in such a way that it is elevated toward the inside (medial) when the chair 1 or the exercise assisting tool 21 is seen in a front view. In this case, a repulsive force of the coil spring that occurs when the pelvis carries out a roll turn acts in such a way that the pelvis faces slightly inward, whereby it becomes possible to effectively return the pelvis that has carried out a roll turn to the neutral state. The same goes for a coil spring that is disposed instead of the left ischium balloon 16L. Further, instead of each balloon 16, another elastic body such as rubber may be employed.

Further, the right ischium balloon 16R, the left ischium balloon 16L, and the coccyx balloon 16T may be integrally formed instead of being formed as separate bodies. In some embodiments, however, the internal spaces of the right ischium balloon 16R, the left ischium balloon 16L, and the coccyx balloon 16T are separated from one another. This is because, if they are not separated from one another, the right ischium balloon 16R and the left ischium balloon 16L will not likely to generate repulsive forces when the pelvis carries out a roll turn.

Further, the support mechanism 11 may include a plurality of coccyx balloons 16T. In this case, these plurality of coccyx balloons 16T are disposed posterior to the right ischium balloon 16R and the left ischium balloon 16L.

Further, the yaw oscillation mechanism 13 may be omitted. In FIG. 9, when the chair 20 itself supports the seating surface 20*a* in such a way that the seating surface 20*a* can carry out a yaw turn, the yaw oscillation mechanism 13 included in the exercise assisting tool 21 may be omitted.

The pedals 5 according to the present disclosure may be applied to lower limb exercise devices of all kinds. The lower limb exercise device may be a rowing exercise device 2 shown as an example, Aerobike (registered trademark), a recumbent bike, or a foot pedal wheelchair.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A lower limb exercise device comprising:

a pair of pedals; and a device body that guides the pair of pedals in such a way that the pair of pedals repeatedly move along a predetermined trajectory, wherein a user performs a lower limb exercise by putting his/her feet on the pair of respective pedals, and each pedal is configured in such a way that a relative roll turn of a forefoot part of the foot of the user relative to the device body is prevented while a relative roll turn of a rearfoot part of the foot of the user relative to the forefoot part is allowed, whereby a relative roll turn of the rearfoot part relative to the forefoot part occurs during the lower limb exercise, each pedal comprises:

a cup part that can accommodate the forefoot part and cannot carry out a roll turn relative to the device body; and tightening means for squeezing the cup part inward, and wherein the cup part is squeezed inward by the tightening means, whereby a relative roll turn of the forefoot part relative to the device body is prevented while a relative roll turn of the rearfoot part relative to the forefoot part is allowed.

2. The lower limb exercise device according to claim 1, wherein each pedal comprises:

a front orthosis configured to be attached to the forefoot part and cannot carry out a roll turn relative to the device body;

a rear orthosis configured to be attached to the rearfoot part; and a coupling part that couples the front orthosis to the rear orthosis in such a way that the front orthosis and the rear orthosis can carry out a roll turn relative to each other, and the front orthosis is configured to be attached to the forefoot part and the rear orthosis is configured to be attached to the rearfoot part, whereby a relative roll turn of the forefoot part relative to the device body is prevented while a relative roll turn of the rearfoot part relative to the forefoot part is allowed.

3. An exercise system comprising:

the lower limb exercise device according to claim 2; and a seat on which the user who performs the lower limb exercise using the lower limb exercise device sits, wherein the seat is configured in such a way that the seat can carry out a roll turn relative to the device body.

4. The exercise system according to claim 3, wherein the seat is further configured in such a way that the seat can carry out a yaw turn relative to the device body.

5. The lower limb exercise device according to claim 1, wherein each pedal comprises:

a front plate configured to be mounted by the forefoot part and which cannot carry out a roll turn relative to the device body; and a grip bar that is fixed to the front plate and configured to be gripped by a toe of the forefoot part, and the forefoot part is placed on the front plate and the grip bar configured to be gripped by the toe of the forefoot part, whereby a relative roll turn of the forefoot part relative to the device body is prevented while a relative roll turn of the rearfoot part relative to the forefoot part is allowed.

6. An exercise system comprising:

the lower limb exercise device according to claim 5; and a seat on which the user who performs the lower limb exercise using the lower limb exercise device sits, wherein the seat is configured in such a way that the seat can carry out a roll turn relative to the device body.

7. The exercise system according to claim 6, wherein the seat is further configured in such a way that the seat can carry out a yaw turn relative to the device body.

8. The lower limb exercise device according to claim 1, wherein each pedal is configured to allow a relative yaw turn of the forefoot part relative to the device body.

9. An exercise system comprising:

the lower limb exercise device according to claim 8; and a seat on which the user who performs the lower limb exercise using the lower limb exercise device sits, wherein the seat is configured in such a way that the seat can carry out a roll turn relative to the device body.

10. The exercise system according to claim 9, wherein the seat is further configured in such a way that the seat can carry out a yaw turn relative to the device body.

11. An exercise system comprising:

the lower limb exercise device according to claim 1; and a seat on which the user who performs the lower limb exercise using the lower limb exercise device sits, wherein the seat is configured in such a way that the seat can carry out a roll turn relative to the device body.

12. The exercise system according to claim 11, wherein the seat is further configured in such a way that the seat can carry out a yaw turn relative to the device body.

13. The lower limb exercise device according to claim 1, wherein tightening means is a shoelace.

14. An exercise system comprising:

the lower limb exercise device according to claim 13; and a seat on which the user who performs the lower limb exercise using the lower limb exercise device sits, wherein the seat is configured in such a way that the seat can carry out a roll turn relative to the device body.

15. A lower limb exercise device comprising:

a pair of pedals; and a device body that guides the pair of pedals in such a way that the pair of pedals repeatedly move along a predetermined trajectory, wherein a user performs a lower limb exercise by putting his/her feet on the pair of respective pedals, and each pedal is configured in such a way that a relative roll turn of a forefoot part of the foot of the user relative to the device body is prevented while a relative roll turn of a rearfoot part of the foot of the user relative to the forefoot part is allowed, whereby a relative roll turn of the rearfoot part relative to the forefoot part occurs during the lower limb exercise, each pedal comprises:

a front orthosis configured to be attached to the forefoot part and cannot carry out a roll turn relative to the device body;

a rear orthosis configured to be attached to the rearfoot part; and a coupling part that couples the front orthosis to the rear orthosis in such a way that the front orthosis and the rear orthosis can carry out a roll turn relative to each other, and wherein the front orthosis is configured to be attached to the forefoot part and the rear orthosis is configured to be attached to the rearfoot part, whereby a relative roll turn of the forefoot part relative to the device body is prevented while a relative roll turn of the rearfoot part relative to the forefoot part is allowed.

16. An exercise system comprising:

the lower limb exercise device according to claim 15; and a seat on which the user who performs the lower limb exercise using the lower limb exercise device sits, wherein the seat is configured in such a way that the seat can carry out a roll turn relative to the device body.

17. The exercise system according to claim 16, wherein the seat is further configured in such a way that the seat can carry out a yaw turn relative to the device body.

* * * * *